US006698947B2

(12) United States Patent
Lenz et al.

(10) Patent No.: US 6,698,947 B2
(45) Date of Patent: Mar. 2, 2004

(54) SUBSTRATE AND CARRIER AND METHOD OF FORMING SAME

(75) Inventors: Gary A. Lenz, Eden Prairie, MN (US); William Gibbs, Steamboat Springs, CO (US)

(73) Assignee: Fargo Electronics, Inc., Eden Prairie, MN (US)

( * ) Notice: Subject to any disclaimer, the term of this patent is extended or adjusted under 35 U.S.C. 154(b) by 73 days.

(21) Appl. No.: 10/113,741

(22) Filed: Apr. 1, 2002

(65) Prior Publication Data

US 2002/0157544 A1 Oct. 31, 2002

Related U.S. Application Data

(62) Division of application No. 09/711,755, filed on Nov. 13, 2000.
(60) Provisional application No. 60/165,347, filed on Nov. 12, 1999.

(51) Int. Cl.[7] ..... B41J 3/28
(52) U.S. Cl. ..... 400/48; 101/35; 101/126
(58) Field of Search ..... 101/35, 41, 126, 101/480, 481, 474; 400/48

(56) References Cited

U.S. PATENT DOCUMENTS

| | | | | |
|---|---|---|---|---|
| 5,022,960 A | * | 6/1991 | Takeyama et al. | 216/13 |
| 5,609,102 A | * | 3/1997 | Rapp | 101/127.1 |
| 5,682,817 A | * | 11/1997 | Iannuzi et al. | 101/126 |
| 5,797,688 A | | 8/1998 | Wen | 400/48 |
| 5,927,208 A | * | 7/1999 | Hagstrom et al. | 101/486 |
| 6,312,174 B1 | * | 11/2001 | Drynkin et al. | 400/120.16 |

* cited by examiner

*Primary Examiner*—Ren Yan
(74) *Attorney, Agent, or Firm*—Westman, Champlin & Kelly

(57) ABSTRACT

The present invention is directed to a carrier for use with a printer that can support irregularly shaped substrates having a top surface. The carrier includes first and second planar members. The first planar member has top and bottom surfaces, a thickness, and an inner edge that conforms to an irregularly shaped outer edge of a substrate. The second planar member has a top surface that is coupled to the bottom surface of the first planar member. A recess, defined by the inner edge of the first planar member and the top surface of the second planar member, is adapted to receive the substrate such that top surfaces of the substrate and the first planar member are coplanar.

14 Claims, 4 Drawing Sheets

SUBSTRATE AND CARRIER AND METHOD OF FORMING SAME

CROSS REFERENCE TO RELATED APPLICATION

This is a Divisional of application Ser. No. 09/711,755, filed Nov. 13, 2000 which claims the benefit of U.S. Provisional Patent Application No. 60/165,347, entitled "SUBSTRATE AND CARRIER AND METHOD OF FORMING SAME," filed on Nov. 12, 1999.

FIELD OF THE INVENTION

The present invention relates to a carrier that is adapted to carry a substrate such that a printing system can print on a surface of the substrate.

BACKGROUND OF THE INVENTION

Printing systems are used to print textual and graphical information on various substrates. Most printers require that the substrate be planar especially at the surface that is to be printed on. This is not a problem for paper substrates which can be laid across a roller at the print head to provide the desired planar surface. However, it is also desirable to print on substrates that are not as malleable as paper.

One such substrate is a compact disc (CD), on which labels must be printed. One method used to allow CD's to be passed through a printer involves the use of a carrier that holds the CD during the printing process and maintains the planar and regularly shaped CD at the proper orientation relative to a print head. Such a carrier is described in U.S. Pat. No. 5,797,688, which includes a recess that is substantially equal to the depth or thickness of the CD, so that the surface of the carrier and the surface of the DC held by the carrier form a substantially flat or coplanar surface on which the print head can print textual and graphical images.

One disadvantage of carriers of the prior art is that they are incapable of accommodating substrates having irregular shapes, such as those having irregular peripheral edges and variable thicknesses. For example, it would be desirable to have a carrier that could be used with a printer to support such substrates as key fobs, badges having irregular shapes, tokens, and many other types of irregularly shaped substrates. As a result, there is a need for a carrier that can support such irregularly shaped substrates in such a manner as to allow a printing system to print on a surface of the substrate.

SUMMARY OF THE INVENTION

The present invention is directed to a carrier for use with a printer that can support irregularly shaped substrates having a top surface. The carrier includes first and second planar members. The first planar member has top and bottom surfaces, a thickness, and an inner edge that conforms to an irregularly shaped outer edge of a substrate. The second planar member has a top surface that is coupled to the bottom surface of the first planar member. A recess, defined by the inner edge of the first planar member and the top surface of the second planar member, is adapted to receive the substrate such that the top surfaces of the substrate and the first planar member are coplanar.

The present invention is also directed to a carrier having a substrate that includes first and second planar members and a removable substrate. The first planar member has top and bottom surfaces and a thickness. The second planar member has a top surface coupled to the bottom surface of the first planar member. The removable substrate is formed of a portion of the first planar member as defined by an outer edge.

Additional aspects of the present invention are directed to methods of forming the above described carriers.

DETAILED DESCRIPTION OF THE PREFERRED EMBODIMENTS

The present invention relates to a carrier, generally designated as 10, that can support an irregularly shaped substrate such that textual and graphical images can be printed on the substrate by a printing system. The substrates can have many different shapes and can serve as, for example, identification cards, badges, tokens, key fobs, tags, ornaments, and many other irregularly shaped objects. The carrier supports the substrate as it is passed through a printing system and a top surface of the substrate is presented to a print head of the printing system such that the print head can render textual and graphical images on the top surface of the substrate.

Figure 2:
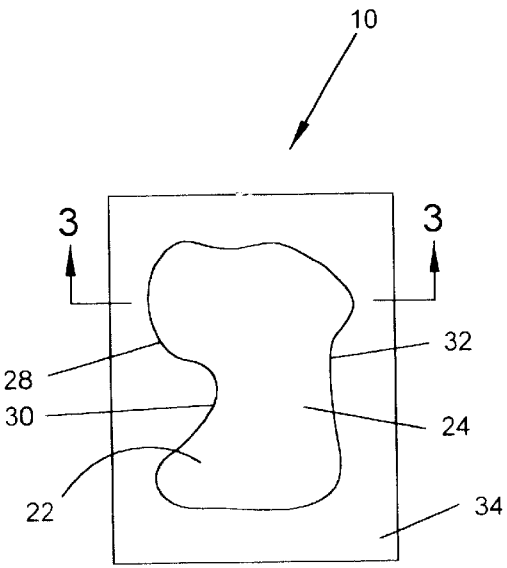
FIG. 2 is a plan view of a carrier in accordance with various embodiments of the present invention.
Figure 1:
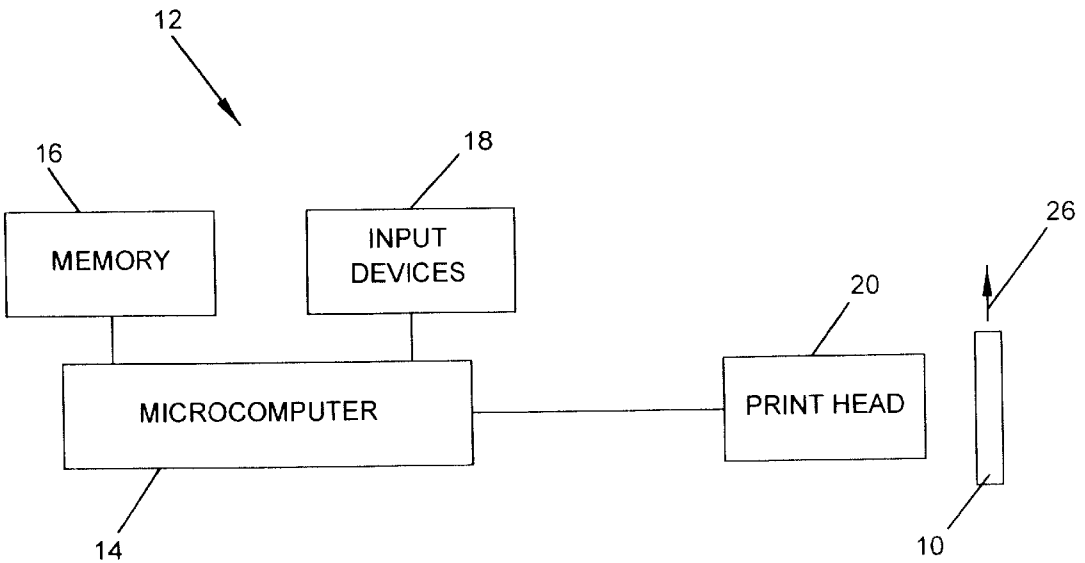
FIG. 1 is a simplified block diagram of an example of a printing system with which a carrier of the present invention may be used.

FIG. 1 illustrates an example of a printing system 12 with which carrier 10 of the present invention may be used. Printing system 12 generally includes microcomputer 14, memory 16, input devices 18, print head 20, and carrier feeder mechanisms (not shown). Printing system 12 is adapted to print text and images onto a substrate 22 that is supported by carrier 10, as shown in FIG. 2, using print head 20. Printing system 12 can be an ink jet, a dye sublimation ribbon, or a resin based printing system, all of which are known in the art.

Microcomputer 14 is preferably a microprocessor-based device of a type well-known in the art. However, in other embodiments, microcomputer 14 can be any analog or digital circuitry capable of implementing the method of the present invention. Memory 16 is coupled to microcomputer 14 and can be any of a large variety of conventional data storage devices for temporarily and/or permanently storing data for use by microcomputer 14. In other embodiments, memory 16 can be integrated within microcomputer 14 instead of being a separate device. Microcomputer 14 can be adapted to process image files produced by a software application and control print head 20 to render the image file on substrate 22.

Input devices 18 are coupled to microcomputer 14 and can be any of a wide variety of devices adapted for providing information and/or control data to microcomputer 14. For instance, input devices 18 can include, for example, a keyboard, a keypad entry device, a sensor, and other types of input devices. Additionally, input devices 18 can include a separate computing system which provides the image files to microcomputer 14 for processing, as mentioned above.

Print head 20 can be an ink jet print head used in an ink jet printing system 12, or a thermal print head that is adapted for use with dye sublimation or resin based printing systems 12. Print head 20 is adapted to print images on a print surface of substrate 22, such as top surface 24 (FIG. 2), when substrate 22 is presented to print head 20 in carrier 10 along a printing path, generally designated by arrow 26 in FIG. 1. A carrier feeder mechanism (not shown) transports carrier 10 along the printing path 26 and presents carrier 10 and substrate 22 to print head 20 for printing in accordance with the specifications of the printing system 12. The carrier feeder mechanism can include drive and pinch rollers, loading trays, or other transport mechanisms that are commonly found in printing systems 12.

Referring now to FIG. 2, substrate 22 generally has an irregularly shaped exterior surface 28, except for a portion which is a flat print surface or top surface 24. In one embodiment, an outer edge 30 of exterior surface 28 is irregularly shaped and carrier 10 includes an irregularly shaped inner edge 32 that conforms to outer edge 30, as shown in FIG. 2. Alternatively, outer edge 30 can be a regular shape such as square, circular, and etc. while exterior surface 28 located below flat print surface 24 is irregularly shaped resulting in a variable thickness to substrate 22. In yet another embodiment, both outer edge 30 and the portion of substrate 22 located below top surface 24 of substrate 22 are irregularly shaped. Substrate 22 could be, an identification card or badge, a token, an ornament, a key fob, or a tag, or other irregularly shaped object. The irregular shape could represent an object, a state, or a company logo, for example.

Various embodiments of carrier 10 are shown in FIGS. 3–6, which are sectional views of carrier taken along line 3—3 of FIG. 2. In order to simplify the discussion of the present invention, the elements of carrier 10 and substrate 22 shown in FIGS. 3–6, which are identified by the same or similar numbers are intended to identify the same or similar elements.

Figure 3:
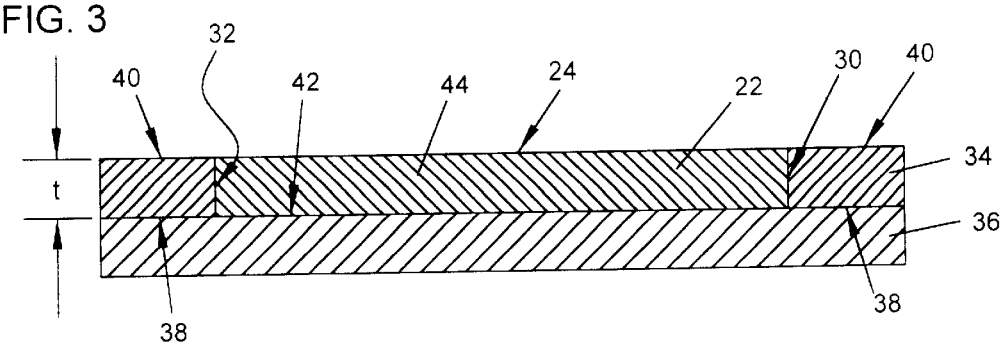
FIGS. 3–6 are sectional views taken along line 3—3 of FIG. 2.
Figure 5:
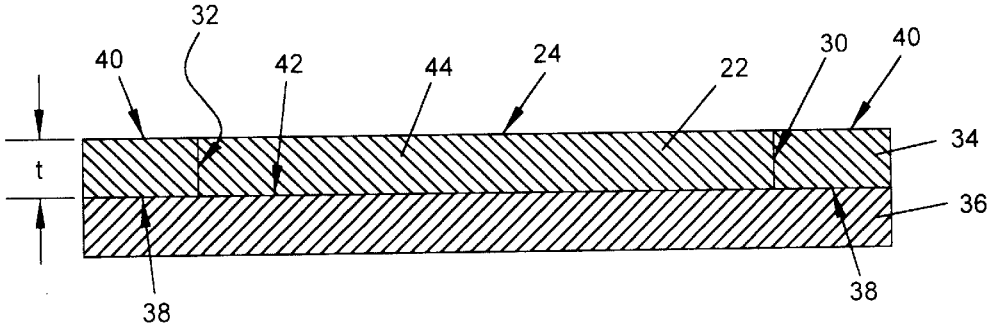
Figure 6:
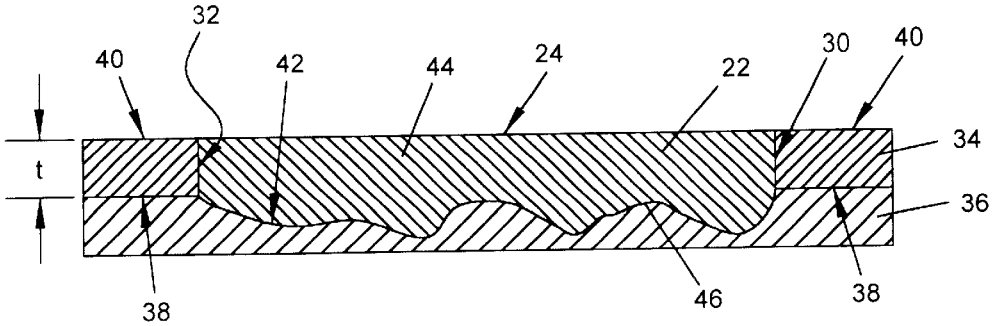

In one embodiment of the invention, carrier 10 includes first and second planar members 34 and 36, respectively, as shown in FIGS. 3, 5, and 6. First planar member 34 includes bottom surface 38, top surface 40, thickness t, and inner edge 32, which conforms to outer edge 30 of substrate 22. Inner edge 32 can be cut using a laser cutter, an electric discharge machine, or other suitable cutting device. In one embodiment, thickness t of first planar member 34 conforms to a thickness of substrate 22, as shown in FIGS. 3 and 5.

Figure 4:
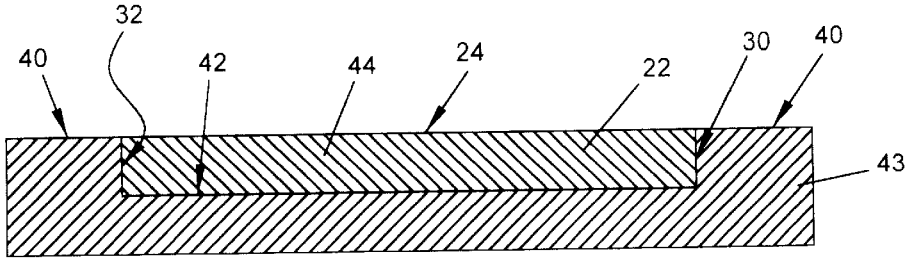

Second planar member 36 includes top surface 42 that is coupled to bottom surface 38 of first planar member 34. First and second planar members 34 and 36 are preferably rigid planar members, which can be formed of plastic, cardboard, metal or other suitable material. Although the depicted embodiments show first and second planar members 34 and 36 having portions removed, they will generally begin as planar members having continuous surfaces prior to being cut to form carrier 10, as will be discussed below in the methods of the present invention. In another embodiment, first and second planar members 34 and 36 can be integrally formed of a single material to form a planar member 43, as shown in FIG. 4.

A recess 44 is defined by top surface 42 of second planar member 36 and inner edge 32 of first planar member 34. Recess 44 is shaped to receive substrate 22 such that top surface 24 of substrate 22 and top surface 40 of first planar member are coplanar. In this embodiment, carrier 10 can be reused to support several different substrates 22.

In another embodiment of the invention, substrate 22 is formed of a portion of first planar member 34, as shown in FIG. 5. Here, inner edge 30 of substrate 22 is preferably be cut prior to the coupling of first planar member 34 to second planar member 36. Once carrier 10 containing substrate 22 has been printed on, substrate 22 can be removed to expose recess 44. Carrier 10 can then be discarded or reused by inserting another substrate 22.

As mentioned above, substrate 22 can have an irregular bottom surface 46 as well as an irregular outer edge 30. FIG. 6 shows one embodiment of carrier 10 that can accommodate the variable thickness of a substrate 22 resulting from irregular bottom surface 46. Here, carrier 10 can be formed either by coupling first and second planar members 34 and 36, respectively, together, or by a single integral unit such as planar member 43 of FIG. 4. Here, top surface 42 of second planar member 36 is shaped to conform to the irregular bottom surface 46 of substrate 22. Recess 44, defined by inner edge 32 of first planar member 34 and top surface 42 of second planar member 36, is shaped to receive substrate 22 having the irregularly shaped bottom surface 46 and/or an irregularly shaped outer edge 30. In this embodiment of carrier 10, first and second planar members are preferably integrally formed of molded plastic. In an alternative embodiment, second planar member 36 is formed of or contains a compressible material that can conform to the shape of irregular bottom surface 46 of substrate 22.

Figure 7:
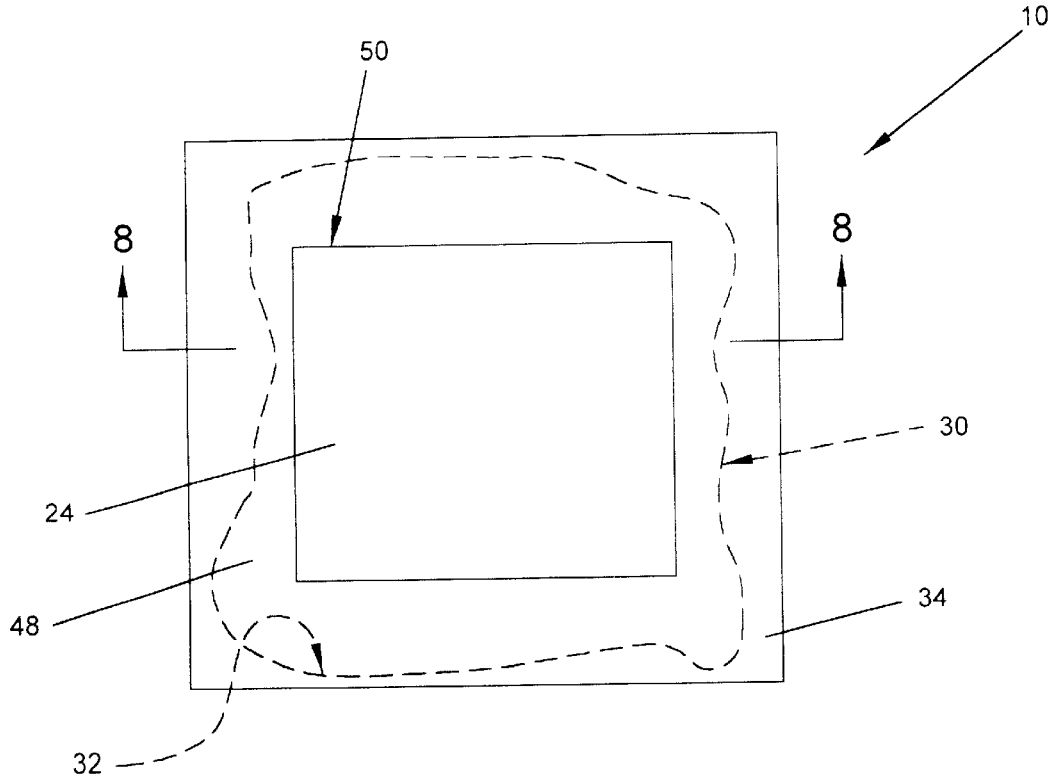
FIG. 7 is a top plan view of a carrier in accordance with an embodiment of the invention.
Figure 8:
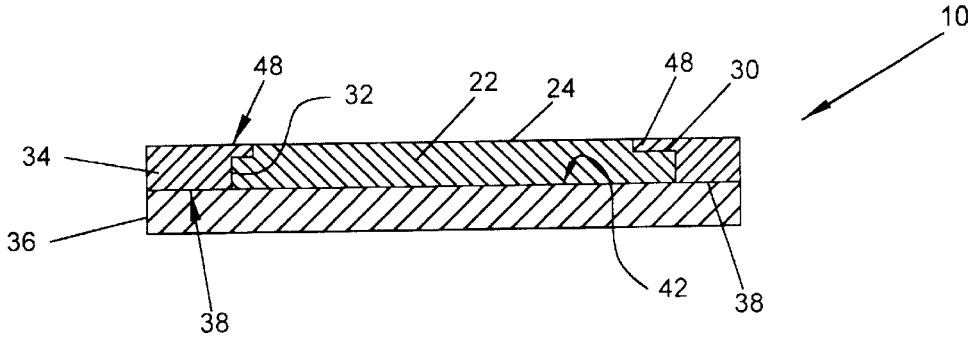
FIG. 8 is a sectional view taken along line 8—8 of FIG. 7.

FIG. 7 shows a top plan view of another embodiment of carrier 10 and FIG. 8 shows a sectional view at line 8—8 of FIG. 7. In this embodiment, first planar member 34 includes a border portion 48 having interior edge 50. Border portion 48 overlaps a portion of substrate 22 and limits the portion of top surface 24 that can be printed on to the portion that is within edge 50 of border portion 48. This embodiment of the invention allows top surface 24 of substrate 22 to have an irregular shape that inner edge 32 of first planar member 34 conforms to in order to present a coplanar surface to the printing system 12.

Figure 10:
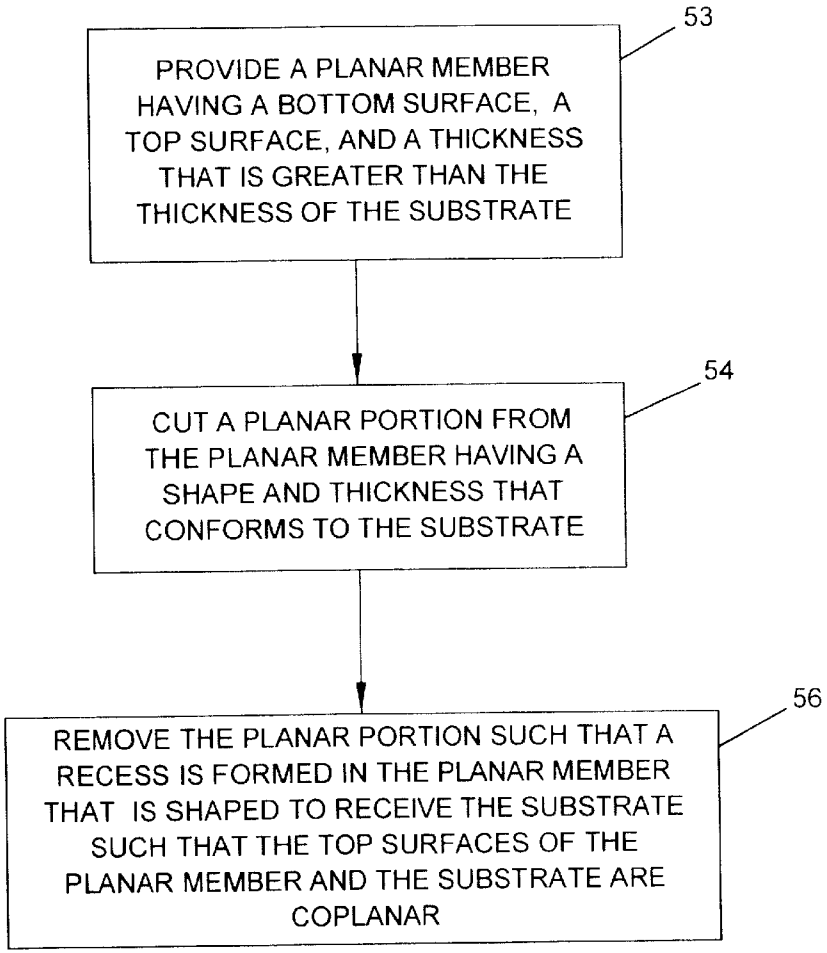
FIGS. 9 and 10 are flowcharts illustrating methods of forming a carrier and a substrate in accordance with embodiments of the invention.
Figure 9:
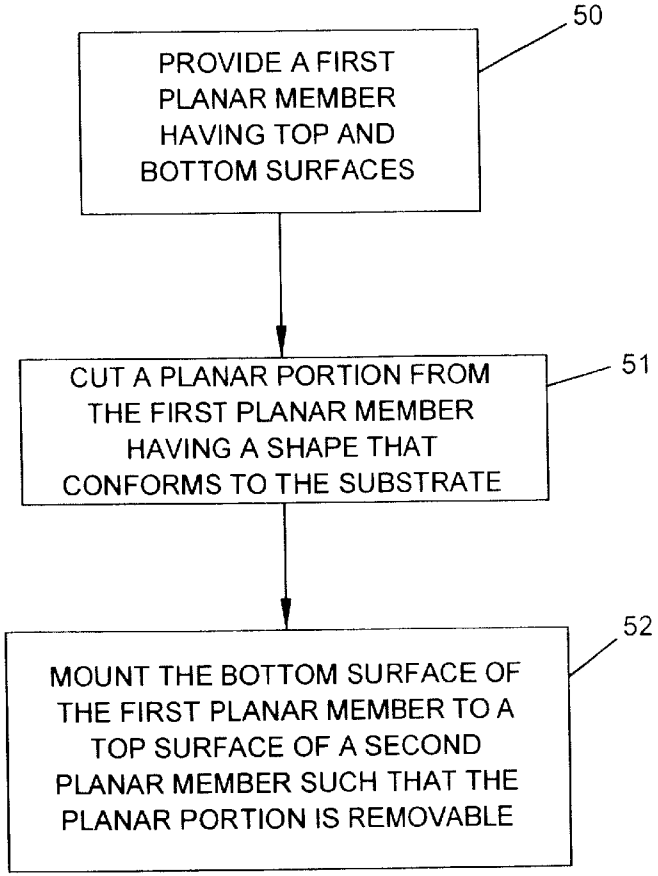

FIGS. 9 and 10 are flowcharts illustrating methods of forming carrier 10 used to hold a substrate 22 in accordance with the various embodiments described above. The method of FIG. 9 relates to forming carrier 10 of separate (non-integral) first and second planar members 34 and 36, respectively. At step 50, a first planar member 34 is provided that has top surface 40 and bottom surface 38. At step 52, a planar portion is cut from the first planar member 34 that has a shape that conforms to substrate 22, such as is shown in FIG. 5. This can be done using a suitable cutting device as mentioned above. Finally, at step 54, bottom surface 38 of first planar member 34 is mounted to a top surface 42 of second planar member 36 such that the planar portion is removable. Here, the planar portion can be replaced with a substrate 22 or the planar portion could form the substrate 22.

The method illustrated in the flowchart of FIG. 10 generally relates to a carrier that is formed of a single planar member 43, as in the embodiment of carrier 10 depicted in FIG. 4. At step 56, a planar member 43 is provided that has a top surface 40 and a thickness that is greater than the thickness of the substrate 24 that is to be supported. A planar portion having a shape and thickness that conforms to the substrate 22 is cut from the planar member, at step 58. Referring to FIG. 4, this step of the method can be accomplished by making a horizontal cut into a planar member 43 to form top surface 42 and another cut directed from top surface 40 to top surface 42 to form inner edge 32. Finally, at step 60, the planar portion is removed to form recess 44 that conforms to the shape of substrate 22. Recess 44 can receive substrate 22 such that top surface 40 of planar member 43 and a top surface 24 of substrate 22 are coplanar.

Although the present invention has been described with reference to preferred embodiments, workers skilled in the art will recognize that changes may be made in form and detail without departing from the spirit and scope of the invention.

What is claimed is:

1. A carrier for use with a printer to support a substrate having a thickness, an outer edge, a top surface including a flat printable surface, and an irregularly shaped bottom surface, the carrier comprising:

a first planar member having a bottom surface, a top surface, a thickness, and an inner edge that is shaped to conform to the outer edge of the substrate; and a second planar member having a top surface coupled to the bottom surface of the first planar member, the top surface of the second planar member having an irregular shape that substantially conforms to the bottom surface of the substrate, wherein the inner edge of the first planar member and the top surface of the second planar member form a recess that is adapted to receive the substrate such that the top surfaces of the substrate and the first planar member are coplanar.

2. The carrier of claim 1, wherein the thickness of the first planar member corresponds to the thickness of the substrate.

3. The carrier of claim 1, wherein the first and second planar members are integrally formed.

4. The carrier of claim 1, wherein the first and second planar members are rigid planar members.

5. The carrier of claim 1, wherein the second planar member is at least partially formed of a compressible material that conforms to the bottom surface of the substrate.

6. The carrier of claim 1, wherein the substrate is selected from a group consisting of an identification card, a key fob, a token, a tag, and an ornament.

7. The carrier of claim 1, wherein:

the first planar member includes a border portion, whereby the border portion overlaps a portion of the top surface of the substrate thereby limiting the area of the top surface that can be printed on.

8. A carrier for use with a printer to support a substrate having a thickness, an outer edge, and a top surface on which material is to be printed, the carrier comprising:

a first planar member having a bottom surface, a top surface, a thickness, an inner edge that is shaped to conform to the outer edge of the substrate, and a border portion, whereby the border portion overlaps a portion of the top surface of the substrate thereby defining a print area of the top surface which can be printed on; and a second planar member having a top surface coupled to the bottom surface of the first planar member, wherein the inner edge of the first planar member and the top surface of the second planar member form a recess that is adapted to receive the substrate such that the top surfaces of the substrate and the first planar member are coplanar.

9. The carrier of claim 8, wherein the first and second planar members are integrally formed.

10. The carrier of claim 8, wherein the first and second planar members are rigid planar members.

11. The carrier of claim 8, wherein the first planar member and the substrate are formed of the same material.

12. The carrier of claim 8, wherein:

the substrate has an irregularly shaped bottom surface; and the top surface of the second planar member is shaped to conform to the bottom surface of the substrate.

13. The carrier of claim 8, wherein:

the substrate has an irregularly shaped bottom surface; and the second planar member is at least partially formed of a compressible material that conforms to the bottom surface of the substrate.

14. The carrier of claim 8, wherein the substrate is selected from a group consisting of an identification card, a key fob, a token, a tag, and an ornament.

* * * * *